United States Patent [19]

Neumann et al.

[11] 4,326,982

[45] Apr. 27, 1982

[54] PROCESS FOR THE MANUFACTURE OF FINE-CRYSTALLINE FLUORESCENT BRIGHTENERS OF THE BIS-TRIAZINYLAMINOSTILBENE SERIES IN THE β-CRYSTAL FORM

[75] Inventors: Konrad Neumann, Wyhlen; Ernst Schenkenberger, Rheinfelden, both of Fed. Rep. of Germany

[73] Assignee: Ciba-Geigy Corporation, Ardsley, N.Y.

[21] Appl. No.: 57,543

[22] Filed: Jul. 13, 1979

Related U.S. Application Data

[63] Continuation of Ser. No. 839,693, Oct. 5, 1977, abandoned.

[30] Foreign Application Priority Data

Oct. 14, 1976 [DE] Fed. Rep. of Germany ..... 2646273

[51] Int. Cl.[3] ..... D06L 3/12

[52] U.S. Cl. ..... 252/301.23; 241/30; 542/435; 542/461

[58] Field of Search ..... 252/301.23; 241/30; 542/461, 435

[56] References Cited

U.S. PATENT DOCUMENTS

| | | | |
|---|---|---|---|
| 3,511,833 | 5/1970 | Tscharner | 542/461 |
| 3,630,944 | 12/1971 | Ohkawa et al. | 542/435 |
| 3,781,215 | 12/1973 | Langstroth | 241/30 |
| 3,870,649 | 3/1975 | Langstroth | 241/30 |
| 3,951,960 | 4/1976 | Heath et al. | 252/301.23 |
| 3,962,115 | 6/1976 | Clark et al. | 252/301.23 |

*Primary Examiner*—Arthur P. Demers

*Attorney, Agent, or Firm*—John P. Spitals; Edward McC. Roberts

[57] ABSTRACT

A process for the manufacture of fine-crystalline fluorescent brighteners of the bis-triazinylaminostilbene series in the β-crystal form by mixing the water-containing fluorescent brightener filter cake with an aqueous dispersant solution at temperatures between 70° and 85° C. and grinding at this temperature, is provided.

3 Claims, No Drawings

PROCESS FOR THE MANUFACTURE OF FINE-CRYSTALLINE FLUORESCENT BRIGHTENERS OF THE BIS-TRIAZINYLAMINOSTILBENE SERIES IN THE β-CRYSTAL FORM

This is a continuation of application Ser. No. 839,693 filed on Oct. 5, 1977, now abandoned.

The present invention relates to a process for the manufacture of fine-crystalline fluorescent brighteners of the bis-triazinylaminostilbene series in the β-crystal form.

Bis-triazinylaminostilbenes are very widely used in the colourless β-crystal modification as fluorescent brighteners for detergents. They are prepared in a manner known per se in such a way that, when manufacture is complete, the compounds are obtained in the colourless modification. Because the compounds have only low water-solubility, it is frequently necessary to comminute the particles obtained in the synthesis in order to increase the solubility rate of the fluorescent brighteners and accordingly the white effect which can be achieved with these compounds during washing. It is particularly necessary to comminute the particles whenever the washing is to be carried out at low temperatures.

In actual practice, the comminution of the particles of the compounds which are in the form of colourless crystals of the β-modification is complicated by the fact that, during the grinding process, the crystals are converted into the yellow α-modification. The α-modification is technically undesirable, for it imparts a yellow colouration to the detergent when incorporated thereinto.

Various processes with the aid of which it is possible to manufacture fine-crystalline fluorescent brighteners of the bis-triazinylaminostilbene series in the β-crystal form and to prevent any conversion of the colourless crystals of the β-modification into the yellow crystals of the α-modification, are known from the patent literature.

For example, U.S. Pat. No. 3,630,944 discloses a process in which the grinding is carried out either in organic solvents or mixtures of solvents or in aqueous solutions with the addition of alkali phosphates and/or alkali silicates.

However, the use of organic solvents complicates the manufacture, since grinding in solvents necessitates special technical measures and, when the grinding is complete, the fluorescent brighteners have to be freed completely from the solvent for safety reasons.

The use of aqueous solutions of alkali phosphates and/or silicates can have disadvantages in producing the fluorescent brightener in marketable form. This is particularly the case when, as described in the Examples of U.S. Pat. No. 3,630,944, the ratio of fluorescent brightener to alkali phosphate is 2:1 to 1:1.

Consequently, the composition of a marketable form which is to be prepared from the ground fluorescent brighteners is no longer freely adjustable and this circumstance can have an unfavourable effect on the development of optimum liquid or solid marketable forms.

The disadvantage of the presence of large amounts of inorganic salts in the fluorescent brightener obtained by grinding turns out to be particularly pronounced in the processes described in U.S. Pat. Nos. 3,781,215 and 3,870,649, in which moist or dried filter cakes are ground in the presence of substantial amounts of sodium sulphate.

It is further known from U.S. Pat. No. 3,511,833 that a conversion from a α-crystal form into the β-crystal form at temperatures below 100° C. and normal pressure can take place only in the presence of an electrolyte and in a water-soluble organic solvent.

It has now been found that a fine-crystalline fluorescent brightener of the bis-triazinylaminostilbene series in the β-crystal form can also be obtained by grinding a coarse-crystalline fluorescent brightener in the α- or β-modification at temperature below 100° C. in the absence of special additives and organic solvents.

The process of the present invention for the manufacture of fine-crystalline fluorescent brighteners of the bis-triazinylaminostilbene series in the β-crystal form by grinding in an aqueous medium comprises mixing the water-containing filter cake of the fluorescent brightener in the β- and/or α-crystal form with an aqueous dispersant solution at a temperature between 70° and 85° C., preferably between 75° and 80° C., and grinding at this temperature.

Preferably, disodium-4,4'-bis-(4''-anilino-6''-morpholino-s-triazin-2''-yl-amino)-2,2'-stilbene disulphonate is used as fluorescent brightener of the bis-triazinylaminostilbene series.

Suitable dispersants are: alkali metal salts, in particular sodium salts, of alkylsulphonic or alkylarylsulphonic acids and alkylcarboxylic or alkylarylcarboxylic acids; alkali metal salts, in particular sodium salts and condensation products of arylsulphonic acids with formaldehyde; macromolecular substances which are suitable for liquifying and dispersing; carboxylates of the polymerised maleic acid or polymerisd acrylic acid type and copolymers of maleic acid with allyl acetate. As examples of such dispersants there may be mentioned: sodium laurylsulphate, sodium oleylsulphate, diethanolamine oleylsulphate, sodium benzylnaphthalenesulphonate, disodium di-(2-sulpho-1-naphthyl)methane, sodium m-xylenesulphonate, sodium dodecylbenzenesulphonate, diethanolamine dodecylbenzenesulphonate, sodium diisopropylnaphthalenesulphonate, sodium di-n-butylnaphthalenesulphonate, sodium n-propyl-n-hexylnaphthalenesulphonate, sodium oleylmethyltaurin, the sodium salt of the condensation product of naphthalenesulphonic acid and formaldehyde, sodium sulphanilate, sodium benzenesulphonate, sodium cumenesulphonate, sodium toluenesulphonate, oxethylated resinous substances, N-polyvinylpyrrolidone, sulphite cellulose lye (CaO-free), starch ethers and polysaccharides.

The dispersant solution, which will advantageously contain from 2 to 10 percent by weight, preferably 5 percent by weight, of the dispersant, is used in such an amount that the ratio of fluorescent brightener to dispersant is between 20:1 and 100:1.

The fluorescent brightener is ordinarily used in the form of the filter cake obtained during its manufacture.

An inorganic salt can be added to the fluorescent brightener suspension in order to lower the viscosity. A suitable inorganic salt is for example sodium chloride or sodium carbonate.

The process of the present invention makes it possible to obtain fluorescent brightener suspensions having a crystal size of less than 10 μ, i. e. after grinding. These suspensions can be processed to marketable liquid or solid formulations with increased cold detergent effect.

The invention is illustrated by the following nonlimitative Examples, in which percentages are by weight unless otherwise stated.

EXAMPLE 1

A filter cake (80 g) containing 42% of disodium-4,4'-bis-(4''-anilino-6''-morpholino-s-triazin-2''-ylamino)-2,2'-stilbene-disulphonate in the β-crystal form is suspended in 20 g of a 5% aqueous solution of the sodium salt of the condensation product of naphthalenesulphonic acid and formaldehyde. This suspension is mixed with 250 g of glass beads, heated to 80° C. and ground for 5 hours at this temperature. The mixture is thereafter sieved through a sieve having a mesh size of 0.3 mm in order to separate the glass beads.

The crystal dispersion obtained as filtrate is spray dried to give a greyish-white powder in the usual bead form. A sample which is suspended in alkaline water shows that the fluorescent brightener is in the β-crystal form with a particle size between 1 and 10 μ.

EXAMPLE 2

A filter cake (70 g) containing 50% of disodium-4,4'-bis-(4''-anilino-6''-morpholino-s-triazin-2''-ylamino)-2,2'-stilbene-disulphonate in the yellow α-crystal form is mixed with 30 g of a 3.5% aqueous solution of the sodium salt of the condensation product of naphthalenesulphonic acid and formaldehyde. The resultant paste is mixed with 300 g of glass beads and ground for 6 hours at 80° C. The mixture is worked up as described in Example 1, affording a dry white powder which contains the brightener in the β-crystal form in a particle size between 1 and 10 μ.

EXAMPLE 3

A filter cake (80 g) containing 42% of disodium-4,4'-bis-(4''-anilino-6''-morpholino-s-triazin-2''-ylamino)-2,2'-stilbene-disulphonate in the yellow α- and in the colourless β-crystal form and 20 g of a 5% aqueous solution of sodium toluene-sulphonate are mixed with 300 g of glass beads. The resultant paste is heated to 80° C. and ground at this temperature until the dispersion is white is colour. The white dispersion is worked up as described in Example 1, affording a dry white powder which contains the fluorescent brightener in the β-crystal form with a particle size between 1 and 10 μ.

EXAMPLE 4

The dispersion prepared in Example 1 is mixed with 10 g of sodium carbonate before it is spray dried, stirred, and subsequently spray dried. The resultant powder (1 g) is incorporated into 100 g of a washing powder which does not contain fluorescent brightener. This detergent is then compared with one that contains a fluorescent brightener which has not been ground at elevated temperature. The washing powder which contains the flourescent brightener obtained according to the invention has a whiter aspect than the comparison washing powder.

EXAMPLE 5

A filter cake (63 g) containing 44% of disodium-4,4'-bis-(4''-anilino-6''-morpholino-s-triazin-2''-ylamino)-2,2'-stilbene-disulphonate in the yellow α- and white β-crystal form is mixed with 37 g of an 0.8% aqueous starch ether solution. The resultant suspension is ground for 5 hours at 80° C. with 300 g of glass beads and the dispersion thereby obtained is worked up as described in Example 1, affording a white powder which contains the fluorescent brightener in the β-crystal form which a particle size between 1 and 10 μ.

EXAMPLE 6

A fluorescent brightener filter cake (83 g) with a 60% solids content of disodium-4,4'-bis-(4''-anilino-6''-morpholino-s-triazin-2''-ylamino)-2,2'-stilbene-disulphonate in the β- and α-crystal form is suspended in 50 g of a 2% aqueous solution of the sodium salt of N-oleylmethyltaurin. Subsequently, 300 g of glass beads are stirred in. The suspension is then heated to 80° C. and ground at this temperature until the dispersion has a particle size between 1 and 10 μ. The further working up is effected as described in Example 1, affording a dry white powder which contains the fluorescent brightener in the β-crystal form with a particle size between 1 and 10 μ.

What we claimed is:

1. A process for the manufacture of fine-crystalline fluorescent brighteners of the bis-triazinylamino-stilbene series in the β-crystal form by grinding in an aqueous medium, which process consists essentially of mixing a water-containing fluoroescent brightener filter cake in the β- and/or α-crystal form with an aqueous organic solution of a dispersant selected from an alkali salt of an alkylsulphonic acid, alkylarylsulphonic acid, alkylcarboxylic acid or alkylarylcarboxylic acid, a condensation product of an arylsulphonic acid with formaldehyde, N-polyvinylpyrrolidone, CaO-free sulphite cellulose lye, starch ethers and polysaccharides, a carboxylate of polymerised maleic acid, a carboxylate of polymerised acrylic acid and a copolymer of maleic acid with allyl acetate in a ratio of fluorescent brightener to dispersant of between about 20:1 and 100:1 by weight at a temperature between 70° and 85° C., and grinding at this temperature.

2. A process according to claim 1 wherein the fluorescent brightener is disoldium-4,4'-bis-(4''-anilino-6''-morpholino-s-triazin-2''-ylamino)-2,2'-stilbene-disulphonate.

3. A process according to claim 2 wherein 1 to 5 percent by weight, referred to the dry weight of the fluorescent brightener, of a dispersant is used.

* * * * *